US006502068B1

(12) United States Patent
Misu

(10) Patent No.: US 6,502,068 B1
(45) Date of Patent: Dec. 31, 2002

(54) MULTIPULSE SEARCH PROCESSING METHOD AND SPEECH CODING APPARATUS

(75) Inventor: Katsuya Misu, Kanagawa (JP)

(73) Assignee: NEC Corporation (JP)

( * ) Notice: Subject to any disclaimer, the term of this patent is extended or adjusted under 35 U.S.C. 154(b) by 178 days.

(21) Appl. No.: 09/664,188

(22) Filed: Sep. 18, 2000

(30) Foreign Application Priority Data

Sep. 17, 1999 (JP) ..... 11-263733

(51) Int. Cl.[7] ..... G10L 19/10
(52) U.S. Cl. ..... 704/216; 704/219; 704/220
(58) Field of Search ..... 704/208, 214, 704/219, 220, 223, 216

(56) References Cited

U.S. PATENT DOCUMENTS

| | | | | |
|---|---|---|---|---|
| 4,924,517 A | | 5/1990 | Yasuhiro | |
| 4,991,214 A | * | 2/1991 | Freeman et al. | 381/38 |
| RE35,057 E | * | 10/1995 | Freeman et al. | 704/223 |
| 5,899,968 A | * | 5/1999 | Navarro et al. | 704/220 |
| 5,963,898 A | * | 10/1999 | Navarro et al. | 704/220 |
| 5,974,377 A | * | 10/1999 | Navarro et al. | 704/220 |
| 6,233,550 B1 | * | 5/2001 | Gersho et al. | 704/208 |

FOREIGN PATENT DOCUMENTS

JP 7-160298 6/1995

OTHER PUBLICATIONS

SALAMI R. ET AL., "Description of ITU–T Recommendation G.729 Annex A: reduced complexity 8 kbit/s CS–ACELP codec", Acoustics, Speech and Signal Processing, 1997, ICASSP–97, 1997 IEEE International Conference on Munich, Germany, Apr. 21–24, 1997, Los Alamitos, Ca., pp. 775–778.

SANG–MIN LEE, ET AL., "Cost–effective implementation of ITU–T G.723.1 on a DSP chip, " Consumer Electronics, 1997, ISCE '97, Proceedings of 1997 IEEE International Symposium on Singapore Dec. 24, 1997, New York, NY, pp. 31–34.

European Search Reported dated Jun. 19, 2002.

* cited by examiner

*Primary Examiner*—Susan McFadden
(74) *Attorney, Agent, or Firm*—Dickstein, Shapiro, Morin & Oshinsky LLP.

(57) ABSTRACT

A speech coding apparatus includes a pulse position candidate table, inter-pulse distortion table, first and second reference address tables, first and second reference address table creation units, and search table creation unit. The pulse position candidate table stores the pulse position candidate of each pulse. The inter-pulse distortion table stores a distortion calculated every pulse interval. The first reference address table creation unit regards the pulse position of the inter-pulse distortion table as a relative distance from the start of the inter-pulse distortion table, calculates a distortion every pulse interval to obtain the absolute address of the inter-pulse distortion table, and stores it in the first reference address table. Table creation unit creates a second reference address table accordingly. A multipulse search table is created using these absolute addresses. The search table creation unit reads out absolute addresses from the first and second reference address tables, and creates the multipulse search table using them. A multipulse search processing method is also disclosed.

4 Claims, 11 Drawing Sheets

```
loop r31{
        ;r51 : len_sf
        ;r61 : &faix [0]
        ;r71 : f
        r11 = *dp1++    r71 = *dp4++;                    ①
        r0 = r1-r6   r4 = *dp2##   r3 = *dp5;            ②
        if (r0 < 0)     r3 = r4;                         ③
        r0 = r1-r2                                       ④
        r7 = r7+r2                                       ⑤
        if (r0 >= 0)    r3 = r4;                         ⑥
        r41 = *dp3++    *dp5 = r3h;                      ⑦
        dp5 = r71;                                       ⑧
        dp2 = r41;                                       ⑨
}:
```

FIG. 4

```
loop r31{
    ;r51 : 1en_sf
    ;r61 : & faix [0]
    ;r71 : f
    r0 = r7+r4;                                  ①
    dp6 = r01;                                   ②
    r0 = r1+r2          r3 = *dp5##;             ③
    r0 = r0-r5          r1 = *dp6;               ④
    if (r4>=0)          r1 = r3 ;                ⑤
    r7 = r7+r5         *dp6## = r1h;             ⑥
    clr (rl)          r3 = *dp5:                 ⑦
    r11 = *dp1++        r4 = *dp6;               ⑧
    if (r0>=0)          r3 = r4;                 ⑨
    r4 = r1-r2         *dp6 = r3h;               ⑩
    r0 = r6+r4;                                  ⑪
    dp5 = r01;                                   ⑫
}:
```

(PRIOR ART)

FIG. 11

MULTIPULSE SEARCH PROCESSING METHOD AND SPEECH CODING APPARATUS

BACKGROUND OF THE INVENTION

The present invention relates to a speech coding apparatus and, more particularly, to a speech coding apparatus for coding an input speech signal using an MPEG-4/CELP scheme as one of code excited linear prediction coding schemes of modeling a sound source using a multipulse.

MPEG-4/CELP (Moving Picture Experts Group phase 4) is one of CELP (Code Excited Linear Prediction) schemes as general-purpose speech coding schemes standardized by ISO/IEC (International Organization for Standardization/International Electrotechnical Commission) in February, 1999. There are two coding modes, MPE (MultiPulse Excitation) and RPE (Regular Pulse Excitation) in accordance with the type of sound source code book. In both the MPE and RPE modes, the sound source is modeled by a multipulse made up of a plurality of impulses. However, the degrees of freedom for the pulse position have a difference. The RPE mode uses a constant pulse interval, whereas the MPE mode has a high degree of freedom for the pulse position. Because of this difference, the MPE mode can achieve higher speech quality than in the RPE mode, but suffers a large required calculation amount.

The basic operation of a speech coding apparatus using the MPEG-4/CELP scheme as a speech coding apparatus for the MPE mode will be described with reference to FIG. 5.

As shown in FIG. 5, this speech coding apparatus is constituted by an LPC (Linear Prediction Codec) analysis unit 401, quantization unit 402, LPC filter 403, speech synthesis unit 404, and subtracter 412.

Speed coding is done by segmenting input speech into frames each with a predetermined time, and using the frame as a compression unit.

An input speech signal as original speech is subjected to LPC analysis by the LPC analysis unit 401, and quantized by the quantization unit 402. A code speech-synthesized by the speech synthesis unit 404 and a code quantized by the quantization unit 402 are filtered by the LPC filter 403 to generate reproduced speech. The subtracter 412 calculates the difference between the original speech and the reproduced speech, and outputs an error signal 405. The error signal 405 is input to the speech synthesis unit 404 to select and the parameters of the speech synthesis unit 404 so as to minimize the error signal 405. When the error signal 405 minimizes, the speech synthesis model and input speech are approximate to each other. The parameters of the speech synthesis unit 404 which minimize the error signal 405 form an MPEG-4/CELP code.

The speech synthesis unit 404 comprises multipliers 409 and 410, an adder 411, and three parameters, an ACB (Adaptive Code Book) 406, MP (MultiPulse) code book 407, and GCB (Gain Code Book) 408.

The ACB 406 is generated from many basic speech models of a corresponding person on the basis of the primitive period of the sound source, and generates a pitch period component. The MP code book 407 expresses the noise/error of the sound source by the positions and amplitudes of a plurality of pulses (multipulse), and generates a random component other than the pitch period component. The GCB 408 represents the mixing ratio of the ACB 406 and MP code book 407. That is, the multiplier 409 multiplies a pitch period component generated by the ACB 406 by the mixing ratio of the ACB 406 controlled by the GCB 408, while the multiplier 410 multiplies a random component generated by the MP code book 407 by the mixing ratio of the MP code book 407 controlled by the GCB 408. Outputs from the multipliers 409 and 410 are added by the adder 411 to perform speech synthesis.

Processing of selecting a multipulse which minimizes the error signal 405 from the MP code book 407 is called multipulse search processing. The multipulse search processing method as the feature of the MPE mode is disclosed in Japanese Patent Laid-Open No. 7-160298.

In multipulse search processing, a position where each pulse can be set is uniquely determined for each pulse. Therefore, in multipulse search processing, distortions are calculated and added for respective set pulse position candidates in ascending order of pulse numbers, and a combination exhibiting the smallest distortion is obtained. The "distortion" is a correlation coefficient between adjacent pulses. Multipulse search processing creates a multipulse search table which stores a distortion for each pulse position candidate set for each pulse number, and determines the position and amplitude of each pulse based on the multipulse search table. This multipulse search table must be created for each frame serving as a speech compression unit.

FIG. 6 shows the structure of the MP code book 407 for performing multipulse search processing in a conventional speech coding apparatus.

A search table creation unit 508 creates a multipulse search table 307 on the basis of an inter-pulse distortion table 301 and pulse position candidate table 302.

The contents of the pulse position candidate table 302 are shown in Table 1.

TABLE 1

| Pulse Number | Pulse Position Candidate $m_i$ |
|---|---|
| 1 | 0, 5, 10, 15, 20, 25, 30, 35 |
| 2 | 1, 6, 11, 16, 21, 26, 31, 36 |
| 3 | 2, 7, 12, 17, 22, 27, 32, 37 |
| 4 | 3, 8, 13, 18, 23, 28, 33, 38 |
| 5 | 4, 9, 14, 19, 24, 29, 34, 39 |

The pulse position candidate table exists for each compression bit rate. Table 1 represents a pulse position candidate table for an MPEG-4/CELP compression bit rate of 8,300 bps. The number of pulses is five, and pulses are given by pulse numbers 1, 2, . . . , 5 sequentially from the top. For a bit rate of 8,300 bps, the number of samples in one frame serving as a compression unit is 40, and 40 pulses having an amplitude of ±1 are modeled to be expressed by five pulses. The pulse position candidate table in Table 1 has pulse position candidates for each pulse number. The pulse position candidate interval for each pulse number is uniquely determined.

As the modeling method, the pulse position candidate table is arranged at the nodes of a tree structure as shown in FIG. 7.

FIG. 8 shows the structure of the multipulse search table 307. The structure of the multipulse search table 307 stores a distortion 704 between adjacent pulses for each pulse position candidate 703 present for each pulse number 702. The pulse interval in obtaining each pulse position candidate and a distortion between adjacent pulses varies from 1 to the maximum number of samples of one frame at a pulse position candidate interval. Distortions are calculated every pulse interval, and stored as the inter-pulse distortion table 301 as shown in FIG. 6.

Multipulse search processing in the conventional speech coding apparatus will be explained with reference to the flow charts of FIGS. 9 and 10.

The multipulse search processing sequence has a quadruple loop structure made up of, sequentially from the outer loop, a loop whose end condition (step S901) is whether processing has been performed up to the maximum pulse position candidate interval from an initial value of 1 at a distance increment of 1 using an inter-pulse distance for obtaining a distortion as an index, a loop whose end condition (step S902) is whether processing has been performed for the maximum number of samples of one frame from an initial number of 1 at a pulse position candidate interval of 1, a loop whose end condition (step S903) is whether processing has been performed for the number of pulses to be modeled, i.e., pulse numbers, and a loop whose end condition (step S904) is whether processing has been performed for the number of pulse position candidates at each pulse number. Whether processing has been done for the maximum number of samples of one frame from an initial number of 1 at a pulse position candidate interval of 1 is determined (step S902). Then, a distortion between pulses having a distance set by the outermost loop is obtained, and distortions of one frame are stored in the inter-pulse distortion table 301 (step S905). In these loops, the multipulse search table 307 is created (step S906).

FIG. 10 shows a sequence of creating the multipulse search table 307 in step S906 of FIG. 9.

The start addresses of the pulse position candidate table and inter-pulse distortion table 301 are respectively set as the current pointers of the pulse position candidate table 302 and inter-pulse distortion table 301 (step S1001). In practice, the pulse position candidate table 302 is one-dimensionally arrayed in ascending order of pulse numbers. Whether processing for pulse numbers ends is checked (step S1002). If YES in step S1002, multipulse search table creation processing ends. If NO in step S1002, the start address of the multipulse search table 307 is set as the current address of the multipulse search table 307 (step S1003).

Whether processing for the number of pulse position candidates ends is checked (step S1004). If YES in step S1004, the pulse number is incremented by one (step S1005), and the flow returns to step S1002 for checking whether processing for pulse numbers ends. If NO in step S1004, a pulse position is read out from the current pointer of the pulse position candidate table 302 (step S1006), and the difference between the readout pulse position and an inter-pulse distance in obtaining a distortion is calculated (step S1007). If the difference is 0 or more (step S1008), the difference is added to the current pointer of the multipulse search table 307 (step S1009), and added to the inter-pulse distortion table 301 (step S1010). A distortion value is read out from a position represented by the address obtained in step S1010, and stored in a position represented by the address obtained in step S1009 (step S1011). If the difference is smaller than 0 in step S1008, processing in steps S1009 to S1011 is not executed. Subsequently, the sum of the pulse position and the inter-pulse distance in obtaining a distortion is calculated (step S1012). If the sum is smaller than the number of samples of one frame (YES in step S1013), the sum is added to the current pointer of the multipulse search table 307 (step S1014), and added to the inter-pulse distortion table 301 (step S1015). A distortion value is read out from a position represented by the address obtained in step S1014, and stored in a position represented by the address obtained in step S1015 (step S1016). If the sum is equal to or more than the number of samples of one frame (NO in step S1013), processing in steps S1014 to S1016 is not executed. The number of samples of one frame is added to the current pointer of the multipulse search table 307 (step S1017), and the flow returns to step S1004 for checking whether processing for pulse position candidates ends.

Implementing multipulse search table creation processing by an actual program requires instruction processes of 12 steps corresponding to steps 1006 to 1017 in FIG. 10.

MPEG-4/CELP is used for speech of a video phone or the like as the speech codec of a portable terminal, and thus must execute real-time processing. In the prior art, a processing time necessary for multipulse search processing occupies 50% or more of a time necessary for speech coding. When a speech coding apparatus is to be mounted as software in a digital signal processor (to be referred to as a DSP hereinafter), multipulse search processing requires 17.682 MIPS (Million Instructions Per Second) in terms of the processing time, and the total decoding processing requires 30.64 MIPS, which poses a bottleneck.

This is because the addresses of a reference table and copying destination table for copying a distortion value are calculated in the four loops in processing of creating a multipulse search table to be referred in multipulse search processing, and the number of instructions is 12 steps.

FIG. 11 shows an actual program source list for performing conventional multipulse search table creation processing. Twelve instruction processes in this source list correspond to 12 steps in the flow chart of FIG. 10.

Since the conventional speech coding apparatus calculates the addresses of a reference table and copying destination table for copying a distortion value, many instructions are necessary for multipulse search table creation processing, and multipulse search processing takes a long time.

SUMMARY OF THE INVENTION

It is an object of the present invention to provide a speech coding apparatus capable of increasing the speed of multipulse search processing in MPEG-4/CELP by decreasing the number of instructions necessary for multipulse search table creation processing.

To achieve the above object, according to the present invention, there is provided a speech coding apparatus for, in coding input speech using a multipulse made up of a plurality of pulses, creating a multipulse search table which stores a distortion serving as a correlation coefficient between adjacent pulses of the multipulse for each pulse position candidate of each pulse, and using the multipulse search table to perform multipulse search processing of determining a position and amplitude of each pulse of the multipulse so as to minimize an error between the input speech and reproduced speech, comprising a pulse position candidate table for storing a pulse position candidate of each pulse for a pulse number of the pulse, an inter-pulse distortion table for storing a distortion calculated every pulse interval corresponding to a pulse position of the pulse position candidate table, a first reference address table, a second reference address table, first reference address table creation means for regarding a pulse position of the inter-pulse distortion table represented by the pulse position candidate table as a relative distance from a start of the inter-pulse as distortion table, calculating a distortion every pulse interval corresponding to the pulse position of the pulse position candidate table in advance to obtain an absolute address of the inter-pulse distortion table, and storing the absolute address in the first reference address table, second reference address table creation means for regarding a pulse position of the inter-pulse distortion table represented by the pulse position candidate table as a relative distance from a start of the multipulse search table, calculating a distortion every pulse interval corresponding to the pulse position of the pulse position candidate table in advance to obtain an absolute address of the multipulse search table, and storing the absolute address in the second reference address table, and search table creation means for, in creating the multipulse search table, reading out from the first reference address table an absolute address which uses a pulse position candidate of the inter-pulse distortion table as an index, reading out from the second reference address table an absolute address which uses a pulse position candidate of the multipulse search table as an index, and creating the multipulse search table using the readout absolute address of the multipulse search table and the readout absolute address of the inter-pulse distortion table.

BRIEF DESCRIPTION OF THE DRAWINGS

FIG. 4 is a view showing a program source list for executing the processing shown in FIG. 3;

FIG. 11 is a view showing a program source list for executing the processing shown in FIG. 10.

DESCRIPTION OF THE PREFERRED EMBODIMENT

A preferred embodiment of the present invention will be described in detail below with reference to the accompanying drawings.

Figure 1:
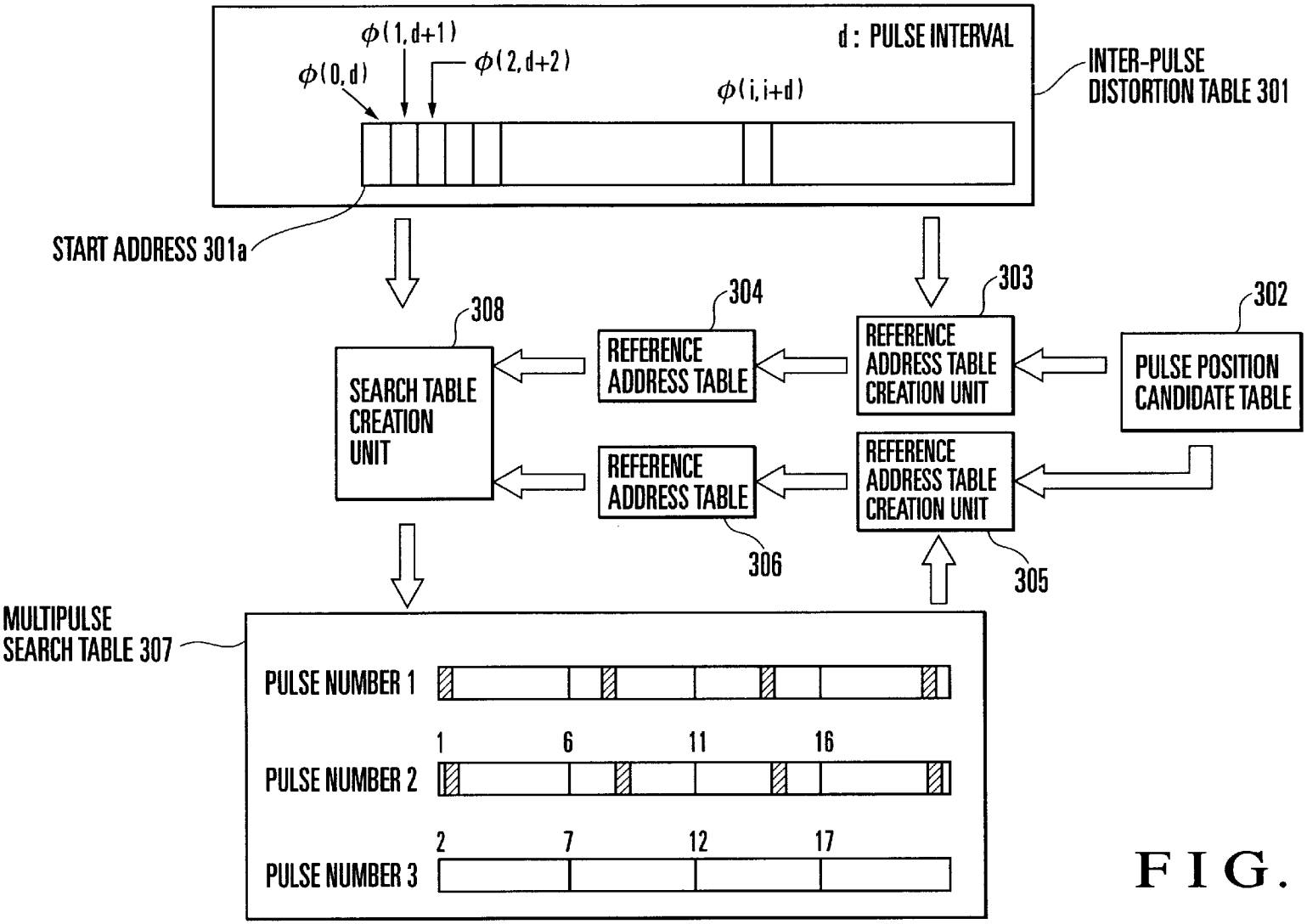
FIG. 1 is a view showing the arrangement of a speech coding apparatus according to an embodiment of the present invention.
Figure 6:
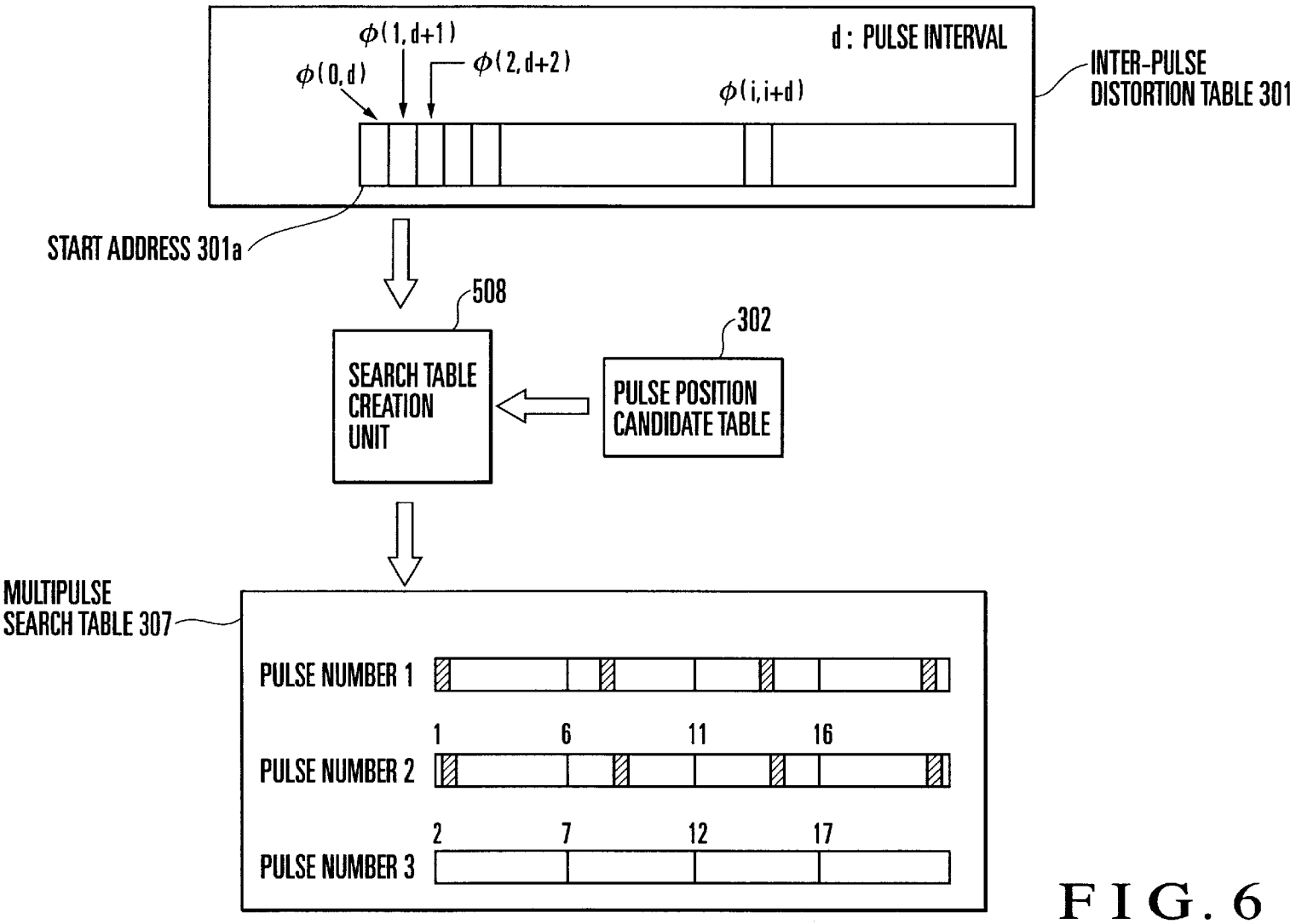
FIG. 6 PRIOR ART
FIG. 6 is a view showing the arrangement of a conventional speech coding apparatus.
Figure 7:
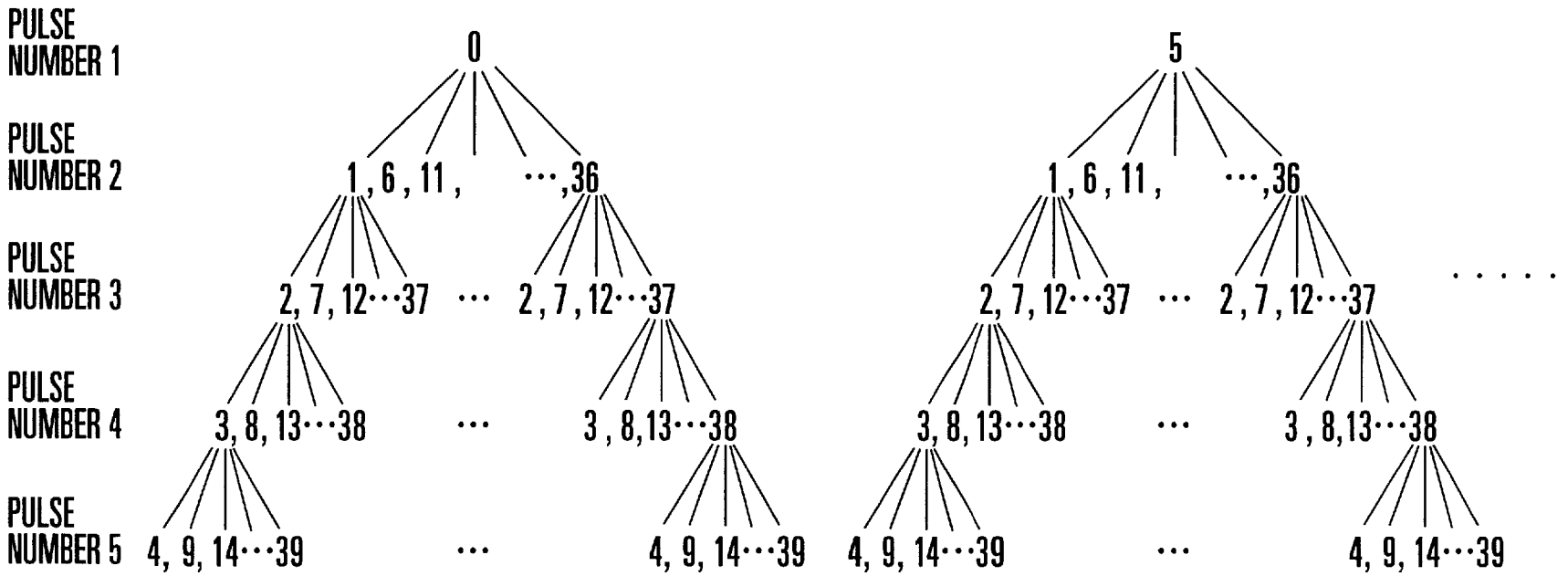
FIG. 7 is a view showing a tree structure.
Figure 8:
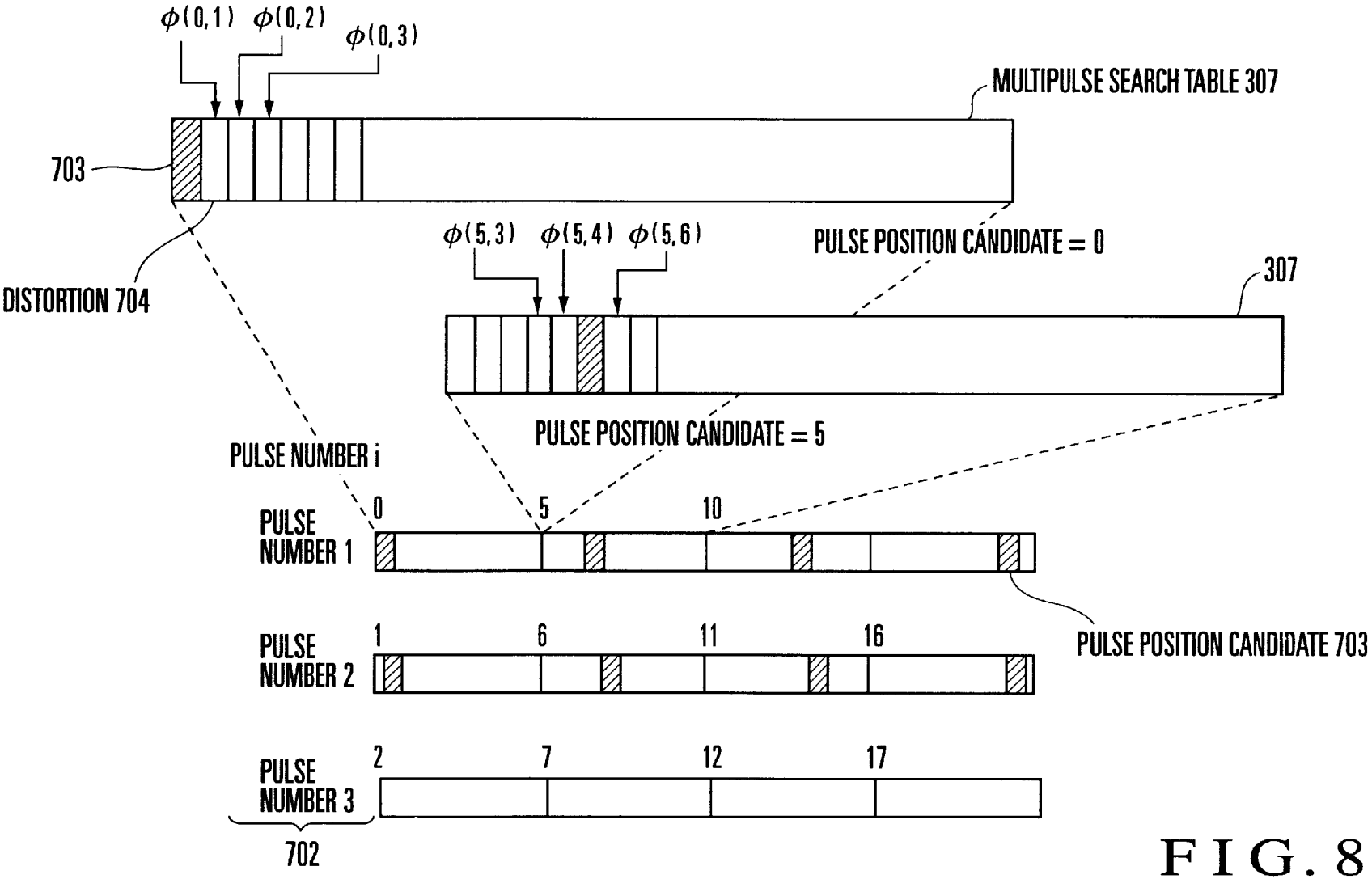
FIG. 8 is a view showing the structure of a multipulse search table.
Figure 9:
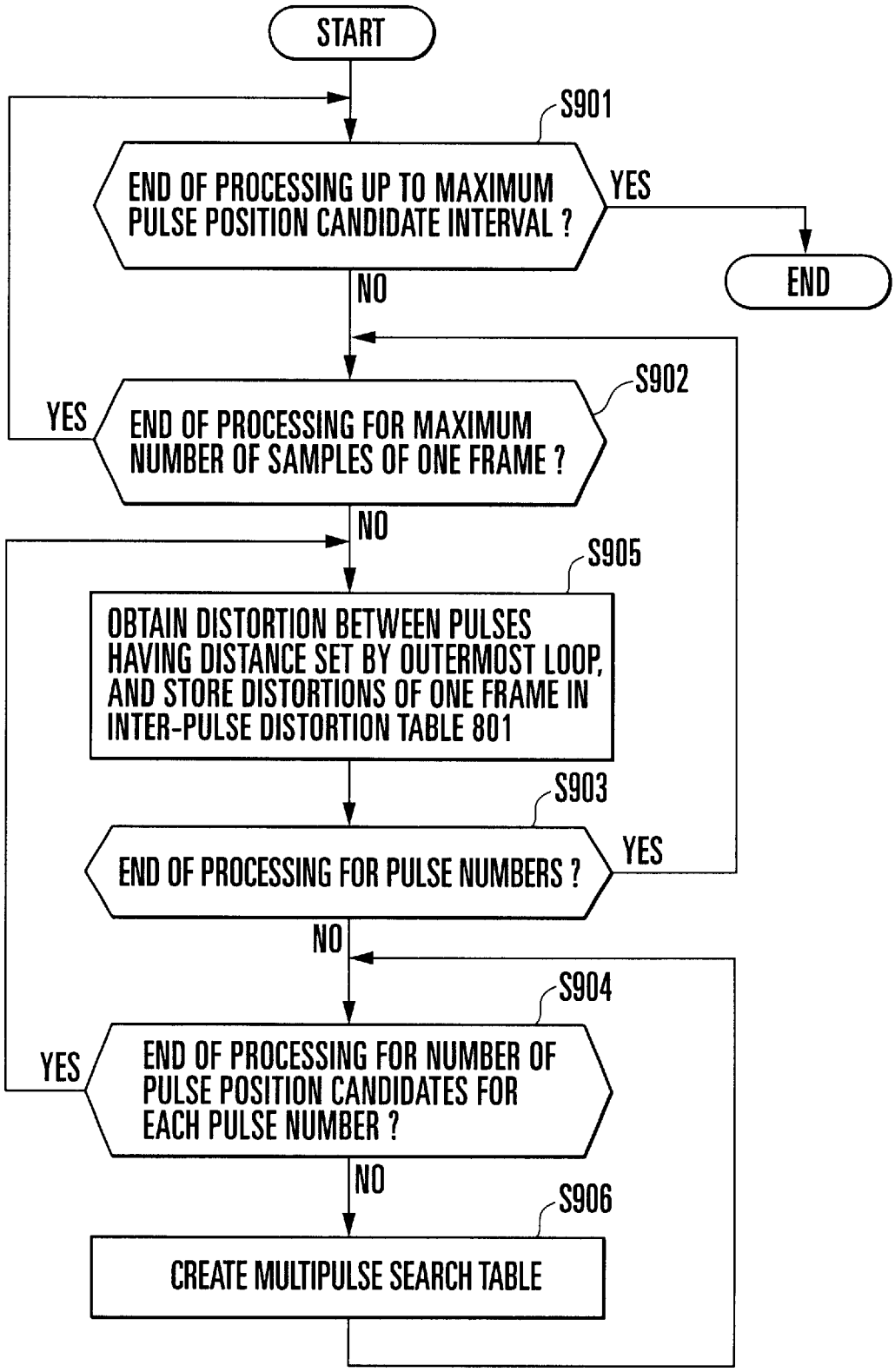
FIG. 9 PRIOR ART
FIG. 9 is a flow chart showing multipulse search processing in the conventional speech coding apparatus.
Figure 10:
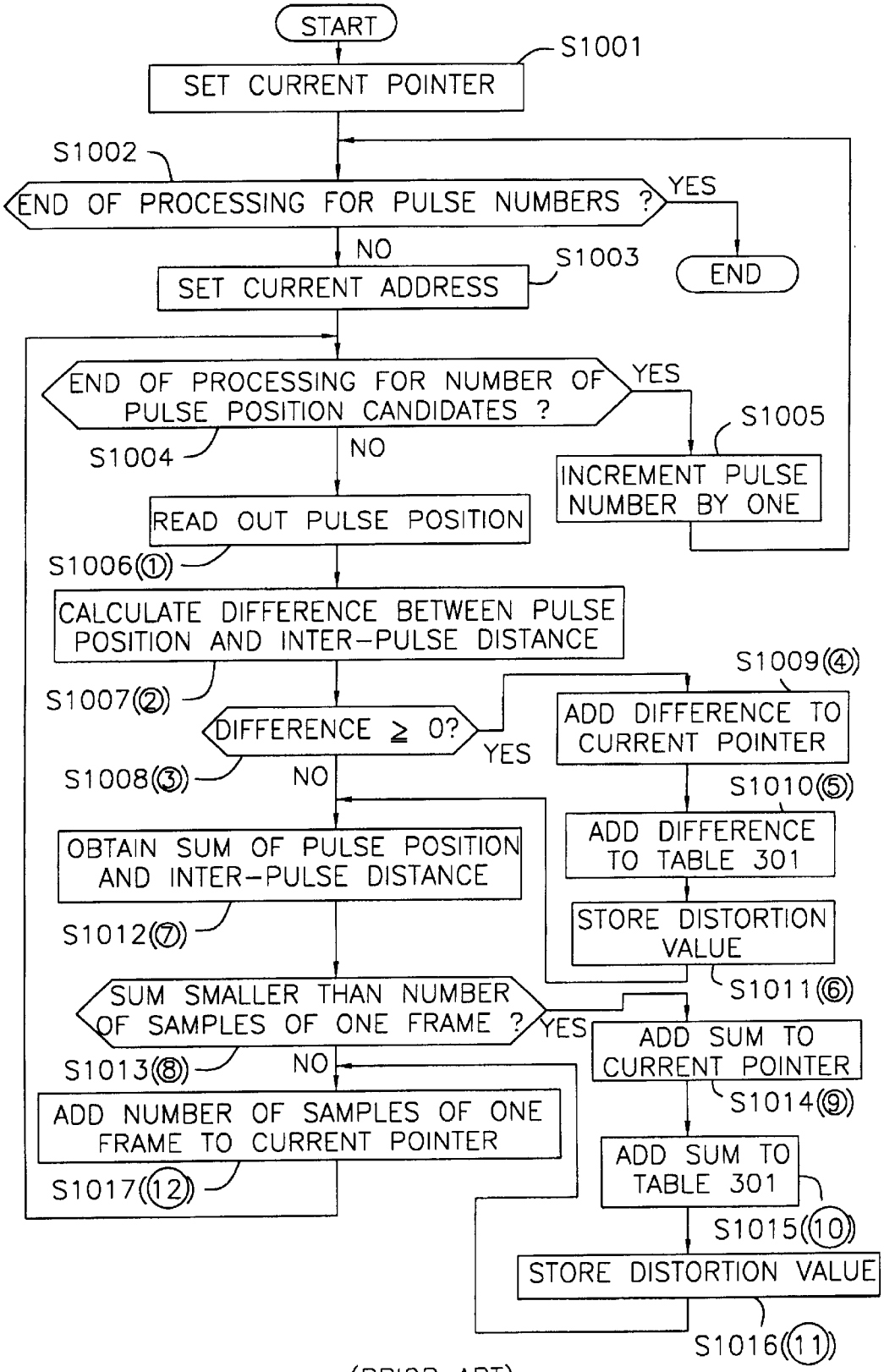
(PRIOR ART) FIG. 10
FIG. 10 is a flow chart showing the sequence of multipulse search table creation processing (step S906) in FIG. 9.

FIG. 1 shows the arrangement of a speech coding apparatus according to an embodiment of the present invention. In FIG. 1, the same reference numerals as in FIG. 6 denote the same parts, and a description thereof will be omitted.

As shown in FIG. 1, the speech coding apparatus of this embodiment comprises an inter-pulse distortion table 301 for storing a distortion calculated every original pulse interval, a pulse position candidate table 302, reference address table creation units 303 and 305, reference address tables 304 and 306, a multipulse search table 307, and a search table creation unit 308.

The reference address table creation unit 303 calculates a distortion every pulse interval, and regards a pulse position of the table represented by the pulse position candidate table 302 as a relative distance from the start of the inter-pulse distortion table 301 in which a distortion is calculated every pulse interval. Further, the reference address table creation unit 303 calculates in advance a distortion every pulse interval corresponding to each pulse position of the pulse position candidate table 302. The reference address table creation unit 303 obtains the absolute address of the inter-pulse distortion table 301, and stores it in the reference address table 304.

Similarly, the reference address table creation unit 305 obtains an absolute address of the multipulse search table 307 corresponding to each pulse position of the pulse position candidate table 302, and stores the absolute address in the reference address table 306.

In creating the multipulse search table 307, the search table creation unit 308 reads out from the reference address table 304 an absolute address which uses the pulse position candidate of the inter-pulse distortion table 301 as an index, and reads out from the reference address table 306 an absolute address which uses the pulse position candidate of the multipulse search table 307 as an index. The search table creation unit 308 creates the multipulse search table 307 using the readout absolute addresses of the multipulse search table 307 and inter-pulse distortion table 301.

Multipulse search processing in the speech coding apparatus of this embodiment will be explained with reference to the flow chart of FIG. 2.

Figure 2:
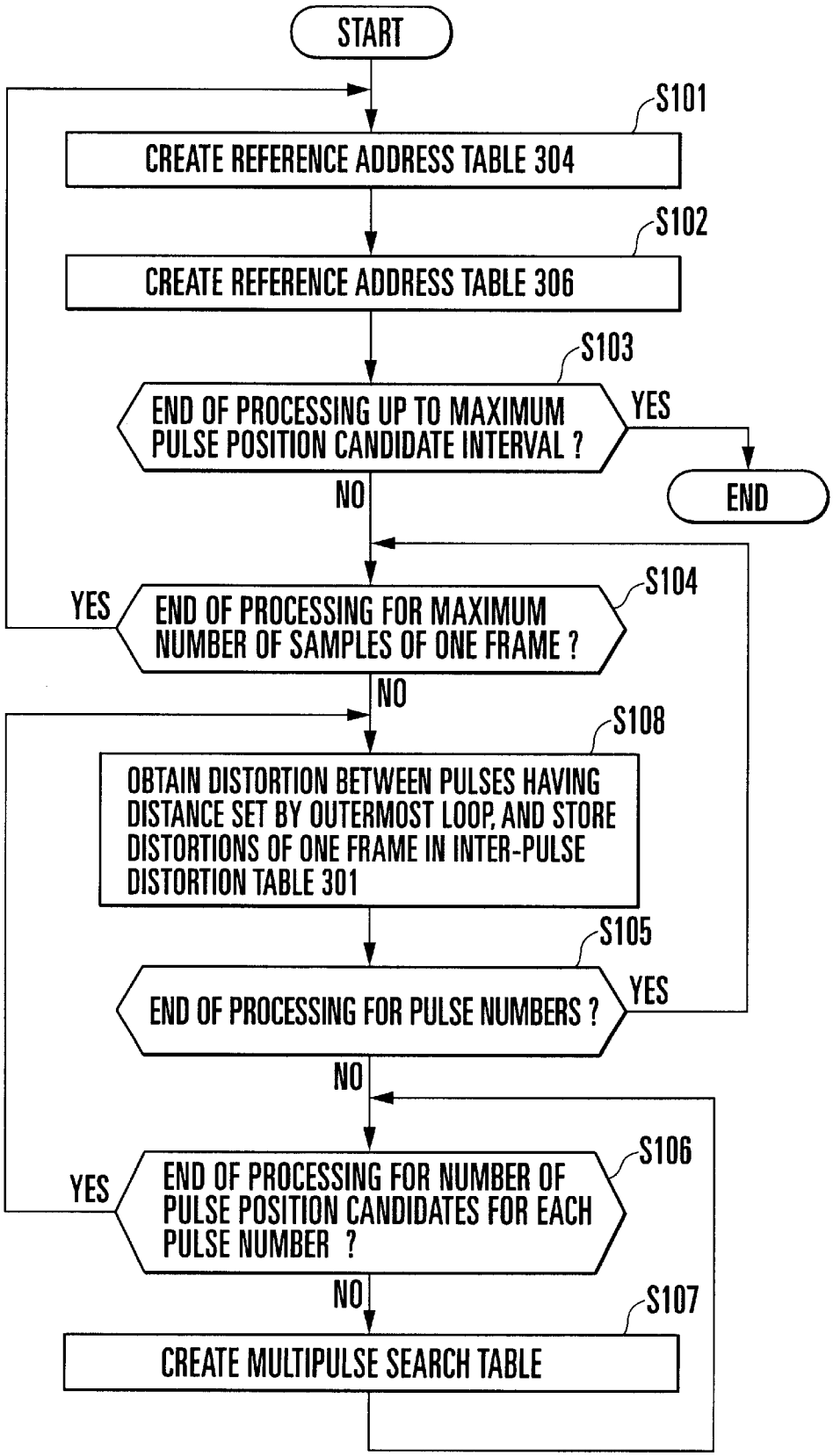
FIG. 2 is a flow chart showing multipulse search processing by the speech coding apparatus in FIG. 1.

In FIG. 2, a pulse position represented by the pulse position candidate table 302 in the inter-pulse distortion table 301 in which a distortion is calculated every pulse interval is regarded as a relative distance from the start of the inter-pulse distortion table 301. A distortion is calculated every pulse interval corresponding to each pulse position of the pulse position candidate table 302 in advance. The absolute address of the inter-pulse distortion table 301 is obtained and stored in the reference address table 304 (step S101). Similarly, an absolute address of the multipulse search table 307 corresponding to each pulse position of the pulse position candidate table 302 is obtained and stored in the reference address table 306 (step S102).

Also in this embodiment, like the prior art, multipulse search table creation processing has a quadruple loop structure made up of, sequentially from the outer loop, a loop whose end condition (step S103) is whether processing has been performed up to the maximum pulse position candidate interval from an initial value of 1 at a distance increment of 1 using an inter-pulse distance for obtaining a distortion as an index, a loop whose end condition (step S104) is whether processing has been performed for the maximum number of samples of one frame from an initial number of 1 at a pulse position candidate interval of 1, a loop whose end condition (step S105) is whether processing has been performed for the number of pulses to be modeled, i.e., pulse numbers, and a loop whose end condition (step S106) is whether processing has been performed for the number of pulse position candidates at each pulse number.

Before step S104 serving as an end condition for the maximum number of samples of one frame from an initial number of 1 at a pulse position candidate interval of 1, a distortion between pulses having a distance set by the outermost loop is obtained, and data of one frame is stored in the inter-pulse distortion table 301 (step S108). After step S106 serving as an end condition, the multipulse search table 307 is created (step S107).

Figure 3:
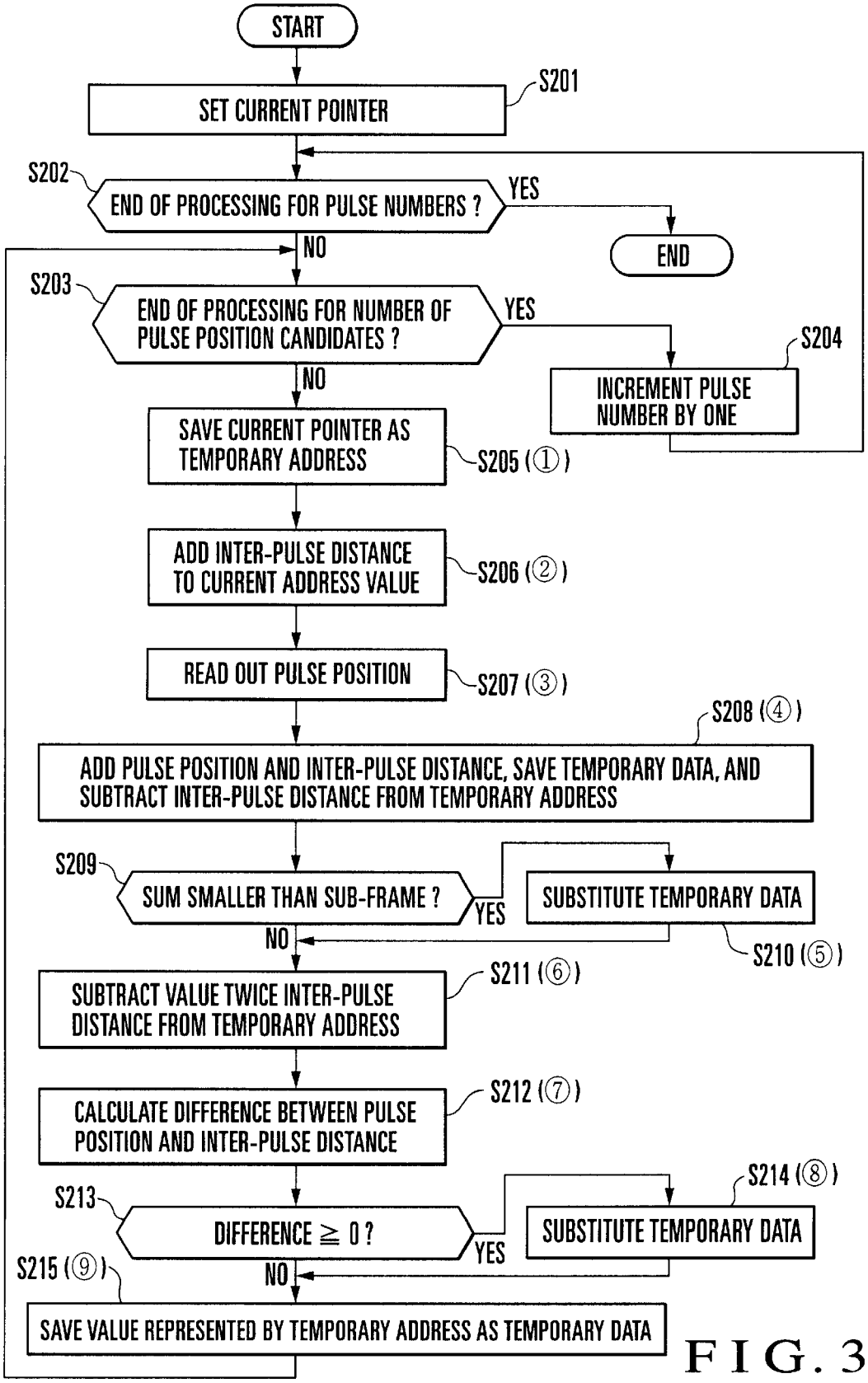
FIG. 3 is a flow chart showing the sequence of multipulse search table creation processing (step S107) in FIG. 2.
Figure 5:
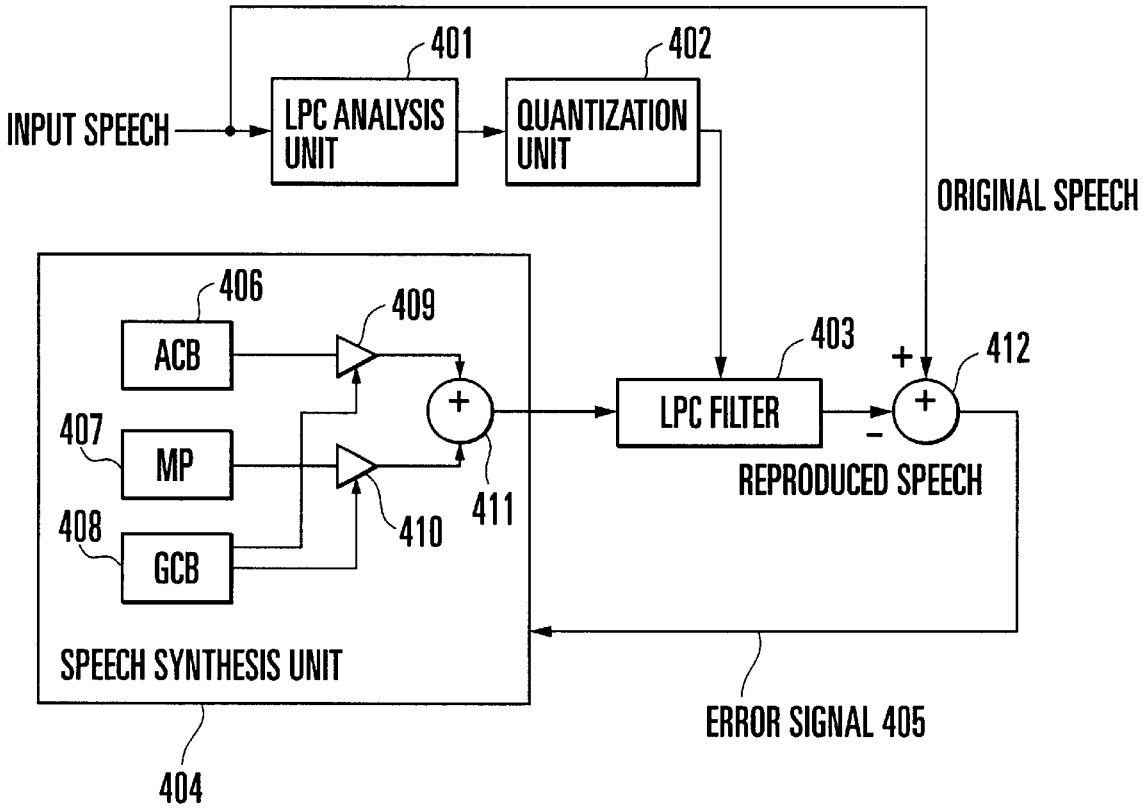
FIG. 5 PRIOR ART
FIG. 5 is a block diagram showing the basic operation of MP-CELP.

FIG. 3 shows a sequence of creating the multipulse search table 307. A start address 302*a* of the pulse position candidate table 302 is set as the current pointer of the pulse position candidate table 302. The start address of the reference address table 304 which is created with reference to the pulse position candidate table 302 and inter-pulse distortion table 301 and stores an absolute address to the inter-pulse distortion table 301 is set as the current pointer of the reference address table 304 which stores an absolute address to the inter-pulse distortion table 301. The start address of the reference address table 306 which is created with reference to the pulse position candidate table 302 and multipulse search table 307 and stores an absolute address to the multipulse search table 307 is set as the current pointer of the reference address table 306 which stores an absolute address to the multipulse search table 307 (step S201). In practice, the pulse position candidate table 302 is one-dimensionally arrayed in ascending order of pulse numbers.

Whether processing for pulse numbers ends is checked (step S202). If YES in step S202, multipulse search table creation processing ends. If NO in step S202, whether processing has been performed for the number of pulse position candidates is checked (step S203). If processing ends in step S203, the pulse number is incremented by one (step S204), and the flow returns to step S202 for checking whether processing has been performed for pulse numbers. If processing has not been performed in step S203, the current pointer of the reference address table 304 is saved as the temporary address of the inter-pulse distortion table 301, and the current pointer is incremented by one (step S205). Further, the inter-pulse distance in obtaining a distortion is added to the current address value of the reference address table 306. The obtained address is saved as the temporary address of the multipulse search table 307, and the current pointer is incremented by one (step S206). A pulse position is read out from the current pointer of the pulse position candidate table 302 (step S207). The sum of the readout pulse position and the inter-pulse distance in obtaining a distortion is calculated. At the same time, data represented by the temporary address value of the multipulse search table 307 obtained in step S206 is saved as temporary air data of the multipulse search table 307. Data represented by the temporary address of the inter-pulse distortion table 301 obtained in step S205 is saved as temporary data of the inter-pulse distortion table 301. The inter-pulse distance in obtaining a distortion is subtracted from the temporary address (step S208).

Whether the sum of the pulse position read out in step S208 and the inter-pulse distance in obtaining a distortion is smaller than the number of sub-frames of one frame is checked (step S209). If YES in step S209, temporary data of the inter-pulse distortion table 301 is substituted as temporary data of the multipulse search table 307 (step S210). Temporary data of the multipulse search table 307 is stored at an address represented by the temporary address of the multipulse search table 307. A value twice the inter-pulse distance in obtaining a distortion is subtracted from the temporary address, and a value represented by the temporary address of the inter-pulse distortion table 301 is saved as temporary data of the inter-pulse distortion table 301 (step S211). Steps S208 and S211 can be executed by one step in the DSP. For example, in step S208, read/save can be executed for two tables (memories) at the same time as addition processing between registers, and address addition/subtraction with respect to a table can be done after read/save.

The difference between the pulse position read out in step S207 and the inter-pulse distance in obtaining a distortion is calculated, and data represented by the temporary address value of the multipulse search table 307 is saved as temporary data of the multipulse search table 307 (step S212). Whether the difference between the pulse position and the inter-pulse distance in obtaining a distortion is 0 or more is checked (step S213). If YES in step S213, temporary data of the inter-pulse distortion table 301 is substituted as temporary data of the multipulse search table 307 (step S214). A value represented by the temporary address of the inter-pulse distortion table 301 is saved as temporary data of the inter-pulse distortion table 301 (step S215), and the flow returns to step S203 for checking whether processing has been performed for the number of pulse position candidates.

As shown in FIG. 3, the number of instructions of multipulse search processing in the speech coding apparatus of this embodiment is nine steps, i.e., steps 205 to 208, 210 to 212, 214, and 215. The number of necessary instructions is smaller than 12 steps in the prior art.

FIG. 4 shows an actual program source list for performing multipulse search table creation processing of this embodiment. Nine instruction processes in this source list correspond to nine steps in the flow chart of FIG. 3.

In the speech coding apparatus of this embodiment, the number of instructions of the four inner loops is decreased from 12 steps to nine steps in multipulse search processing, thereby shortening the total decoding time. This enables real-time processing which cannot be achieved by the prior art. An increase in speed can ensure a free time of the DSP, and the DSP can perform speech quality improvement processing or the like using this free time. The effects are as follows. Table 2 shows the MIPS values of the embodiment and prior art.

TABLE 2

| | Prior Art | Embodiment |
|---|---|---|
| Number of Instructions of Lowermost Loop (Clock) | 12 | 9 |
| Performance in MP Search (MIPS) | 17.682 | 12.968 |
| Performance in Entire Decoding (MIPS) | 30.64 | 26.02 |

As has been described above, the present invention can decrease the number of instructions of the four inner loops in multipulse search processing to increase the speed of multipulse search processing and shorten the decoding time.

What is claimed is:

1. A speech coding apparatus for, in coding input speech using a multipulse made up of a plurality of pulses, creating a multipulse search table which stores a distortion serving as a correlation coefficient between adjacent pulses of the multipulse for each pulse position candidate of each pulse, and using the multipulse search table to perform multipulse search processing of determining a position and amplitude of each pulse of the multipulse so as to minimize an error between the input speech and reproduced speech, comprising:

a pulse position candidate table for storing a pulse position candidate of each pulse for a pulse number of the pulse;

an inter-pulse distortion table for storing a distortion calculated every pulse interval corresponding to a pulse position of the pulse position candidate table;

a first reference address table;

a second reference address table;

first reference address table creation means for regarding a pulse position of the inter-pulse distortion table represented by the pulse position candidate table as a relative distance from a start of the inter-pulse distortion table, calculating a distortion every pulse interval corresponding to the pulse position of the pulse position candidate table in advance to obtain an absolute address of the inter-pulse distortion table, and storing the absolute address in the first reference address table;

second reference address table creation means for regarding a pulse position of the inter-pulse distortion table represented by the pulse position candidate table as a relative distance from a start of the multipulse search table, calculating a distortion every pulse interval corresponding to the pulse position of the pulse position candidate table in advance to obtain an absolute address of the multipulse search table, and storing the absolute address in the second reference address table; and search table creation means for, in creating the multipulse search table, reading out from the first reference address table an absolute address which uses a pulse position candidate of the inter-pulse distortion table as an index, reading out from the second reference address table an absolute address which uses a pulse position candidate of the multipulse search table as an index, and creating the multipulse search table using the readout absolute address of the multipulse search table and the readout absolute address of the inter-pulse distortion table.

2. An apparatus according to claim 1, wherein the multipulse comprises five pulses.

3. A multipulse search processing method of, in coding input speech using a multipulse made up of a plurality of pulses, creating a multipulse search table which stores a distortion serving as a correlation coefficient between adjacent pulses of the multipulse for each pulse position candidate of each pulse, and using the multipulse search table to determine a position and amplitude of each pulse of the multipulse so as to minimize an error between the input speech and reproduced speech, comprising the steps of:

regarding, as a relative distance from a start of an inter-pulse distortion table, a pulse position represented by a pulse position candidate table which stores a pulse position candidate of each pulse for a pulse number of the pulse in the inter-pulse distortion table which stores a distortion calculated every pulse interval corresponding to a pulse position of the pulse position candidate table, calculating a distortion every pulse interval corresponding to the pulse position of the pulse position candidate table in advance to obtain an absolute address of the inter-pulse distortion table, and storing the absolute address in a first reference address table;

regarding a pulse position of the inter-pulse distortion table represented by the pulse position candidate table as a relative distance from a start of the multipulse search table, calculating a distortion every pulse interval corresponding to the pulse position of the pulse position candidate table in advance to obtain an absolute address of the multipulse search table, and storing the absolute address in a second reference address table; and in creating the multipulse search table, reading out from the first reference address table an absolute address which uses a pulse position candidate of the inter-pulse distortion table as an index, reading out from the second reference address table an absolute address which uses a pulse position candidate of the multipulse search table as an index, and creating the multipulse search table using the readout absolute address of the multipulse search table and the readout absolute address of the inter-pulse distortion table.

4. A method according to claim 3, wherein the multipulse comprises five pulses.

* * * * *